US005146861A

United States Patent [19]

Sato et al.

[11] Patent Number: 5,146,861

[45] Date of Patent: Sep. 15, 1992

[54] SEWING MACHINE WITH A BUILT-IN DRIVING MOTOR

[75] Inventors: Katsuhiko Sato, Nagoya; Yasuo Sakakibara, Hekinan; Kohtaro Miyazaki, Nagoya, all of Japan

[73] Assignee: Brother Kogyo Kabushiki Kaisha, Nagoya, Japan

[21] Appl. No.: 665,411

[22] Filed: Mar. 5, 1991

[30] Foreign Application Priority Data

Apr. 26, 1990 [JP] Japan ..... 2-111127
May 18, 1990 [JP] Japan ..... 2-129693

[51] Int. Cl.[5] ..... D05B 75/00
[52] U.S. Cl. ..... 112/259; 112/220
[58] Field of Search ..... 112/259, 220, 221, 258, 112/260; 310/50, 51, 47, 89, 80

[56] References Cited

U.S. PATENT DOCUMENTS 2,188,807 1/1940 Castricone ..... 310/51
3,224,743 12/1965 Freedman et al. ..... 112/258 X
3,597,672 8/1971 Seeselberg ..... 112/220 X
3,821,937 7/1974 Seeselberg ..... 112/220 X
3,954,073 5/1976 Varin ..... 112/259
4,403,867 9/1983 Duke ..... 366/142
4,777,393 10/1988 Peot ..... 310/50
4,807,548 2/1989 Rohr et al. ..... 112/220
4,852,506 8/1989 Salganic ..... 112/220 X
4,873,932 10/1989 Adams ..... 112/220 X

FOREIGN PATENT DOCUMENTS 60-182997 9/1985 Japan .

*Primary Examiner*—Werner H. Schroeder
*Assistant Examiner*—Paul C. Lewis
*Attorney, Agent, or Firm*—Oliff & Berridge

[57] ABSTRACT

A sewing machine includes a bed, a pedestal supported by the bed and an arm extending generally parallel to the bed. One end of the arm is supported by the pedestal, this end having a driving motor located therein. The location of the driving motor suppresses vibration created when the sewing machine is operated and facilitates access thereto.

13 Claims, 4 Drawing Sheets

SEWING MACHINE WITH A BUILT-IN DRIVING MOTOR

BACKGROUND OF THE INVENTION

1. Field of the Invention

The present invention relates to a sewing machine with a built-in driving motor, and more particularly to a sewing machine having an arm in which the driving motor is located.

2. Description of Related Art

Conventionally, a frame of a sewing machine includes a horizontally extending bed, a pedestal standing on the bed at one end portion thereof, and a cantilever arm having one end supported by the pedestal and having the other end extending parallel to the bed. A motor for driving the sewing machine is an AC servo motor or the like, and it is normally mounted under a table on which the sewing machine is mounted.

A driving force of the motor is transmitted through a belt and a pulley provided outside the arm to a main shaft provided in the arm. A needle bar and a thread take-up lever are driven by the rotation of the main shaft. Further, the driving force of the motor transmitted to the main shaft is transmitted through a cam, a vertical shaft, etc. to a bottom shaft provided in the bed. A feed dog and a loop taker are driven by the rotation of the bottom shaft.

U.S. Pat. No. 4,807,548 discloses a sewing machine having a driving motor located in a central portion of an arm. This sewing machine is very compact since the motor is located in the arm.

However, as the central portion of the arm is protruded in the air and is not supported at a lower portion thereof, the location of the motor, which is relatively heavy in the central portion of the arm, causes weight unbalance of the sewing machine. Accordingly, vibration is increased when the sewing machine is driven. Furthermore, the strength of the arm and the pedestal must be made large in order to support the motor, thus causing an increase in weight of the sewing machine. Further, the arm is formed from a cylindrical casting. Therefore, when mounting the motor in the central portion of the arm, it is necessary to deeply insert the motor into the arm and fix the motor to the arm using a long screw. Accordingly, the assembly and disassembly operation of the motor with respect to the arm when maintenance or the like is required becomes very troublesome.

SUMMARY OF THE INVENTION

An object of the present invention is to provide a sewing machine with a built-in driving motor which can maintain weight balance and reduce the vibration of the sewing machine when the sewing machine is driven.

Another object of the present invention is to provide a sewing machine with a built-in driving motor which eliminates the necessity of increasing the strength of the arm and the pedestal, thereby reducing the weight of the sewing machine.

To achieve the above objects, a sewing machine according to the present invention comprises: a bed, a pedestal supported by the bed, an arm having one end supported by the pedestal and having an opposite end extending in a horizontal direction, and a motor for driving the sewing machine, the motor being mounted in the one end portion of the arm.

As mentioned above, the end portion of the arm in which the motor is located is supported by the pedestal. Therefore, the location of the relatively heavy motor in the arm does not cause weight unbalance of the sewing machine. Accordingly, the vibration generated in driving the sewing machine is reduced. Furthermore, as the strength of the arm and the pedestal need not be increased, the weight of the sewing machine is reduced. Additionally, as it is unnecessary to deeply insert the motor into the arm, the assembly and disassembly operation of the motor with respect to the arm can be carried out very easily.

BRIEF DESCRIPTION OF THE DRAWINGS

A preferred embodiment of the present invention will be described in detail with reference to the following figures, wherein.

DETAILED DESCRIPTION OF THE PREFERRED EMBODIMENTS

An embodiment will be described in which the present invention is employed in an industrial sewing machine.

Figure 1:
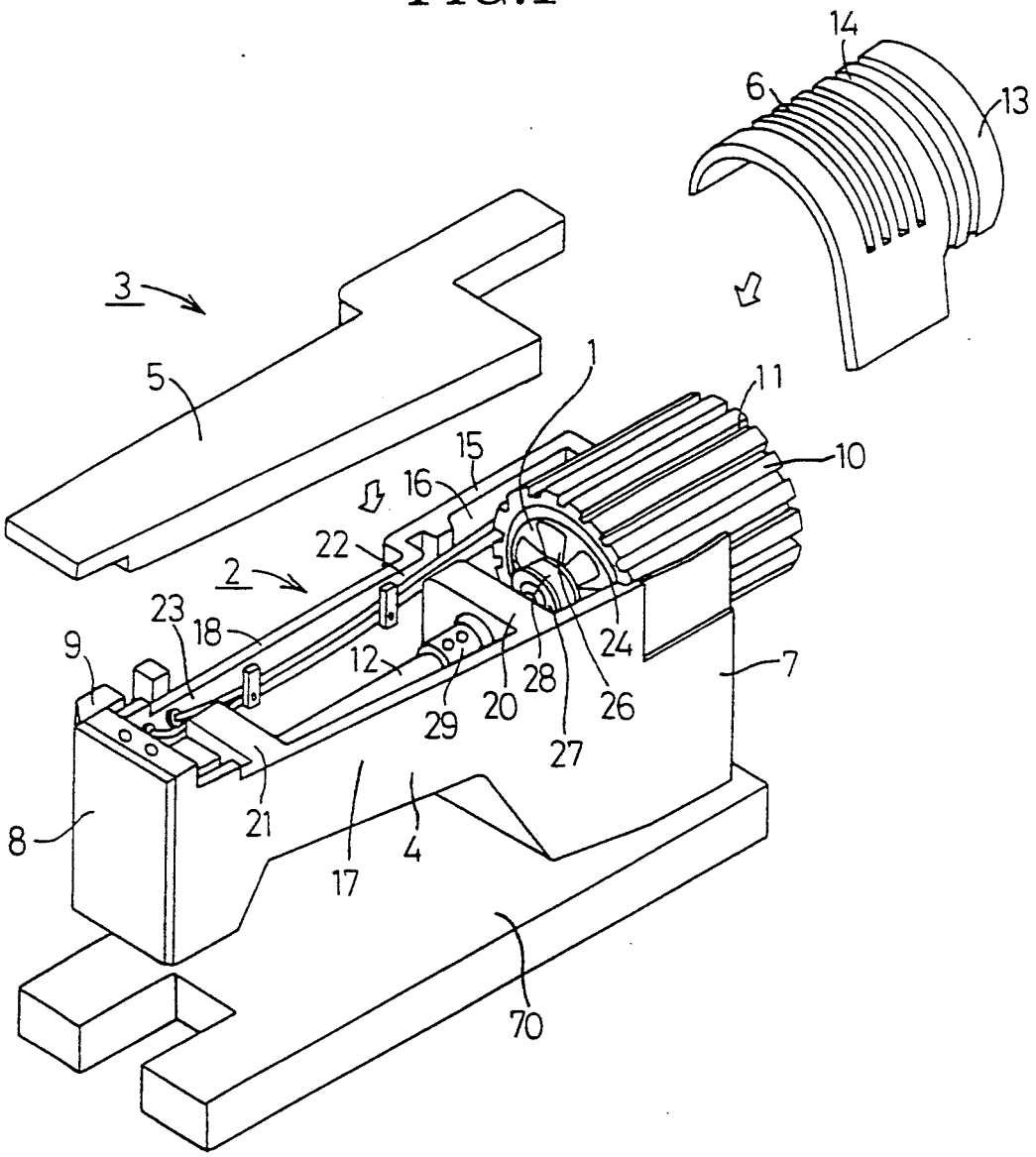
FIG. 1 is an exploded perspective view of the sewing machine according to a preferred embodiment of the present invention.
Figure 2A:
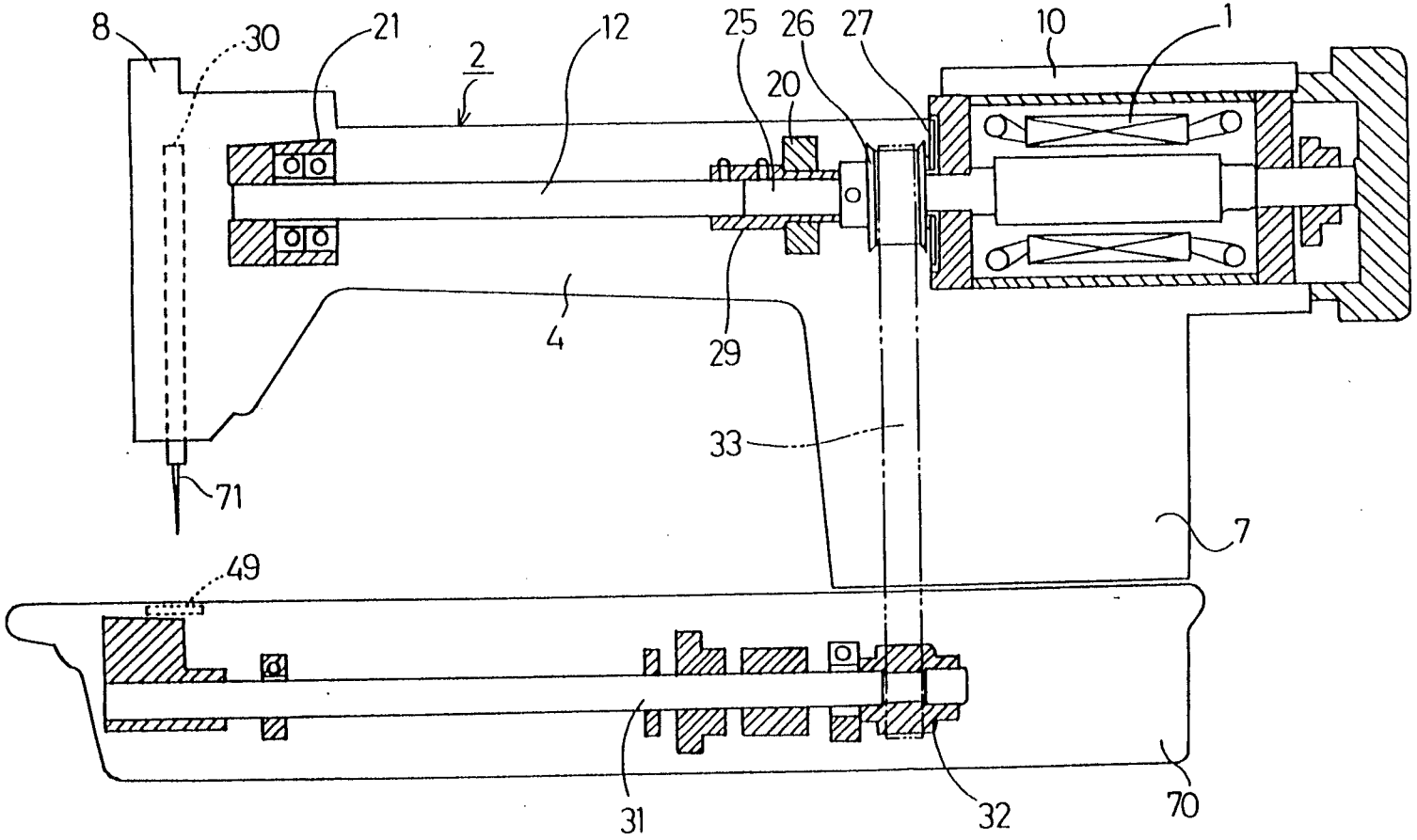
FIG. 2A is a schematic elevational view showing an internal structure of the sewing machine.
Figure 2B:
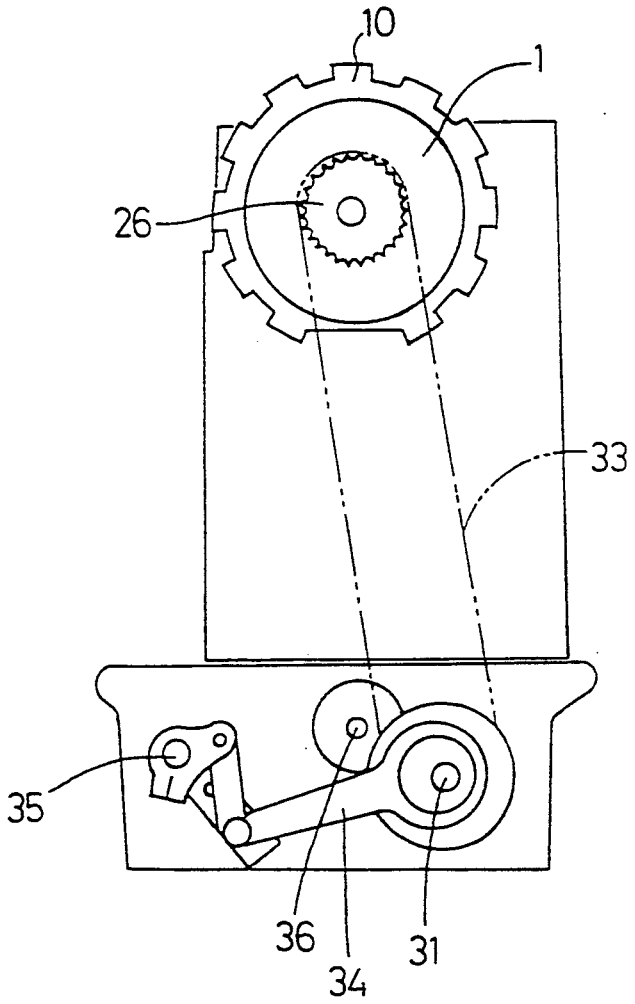
FIG. 2B is a schematic side view showing the internal structure of the sewing machine.

Referring to FIGS. 1, 2A and 2B, a frame 2 formed of die-cast aluminum of a sewing machine 3 according to the preferred embodiment is comprised of a bed 70, a pedestal 7 standing on the bed 70 at one end portion thereof, and an arm 4 extending from the pedestal 7 in parallel to the bed 70. Pedestal 7 comprises a left side wall *7a* and a right side wall *7b* defining an internal hollow *7c*. A cover 5 is detachably mounted on an upper open portion of the arm 4. A cylindrical portion 10 is formed at an end portion of the arm 4 supported by the pedestal 7. An AC servo motor is located in the cylindrical portion 10. A plurality of grooves 11 are formed on an outer circumferential surface of the cylindrical portion 10 so as to extend in a longitudinal direction thereof. A cover 6 is detachably mounted outside the cylindrical portion 10. A plurality of grooves 14 are formed on an outer surface of the cover 6.

A rear wall portion 15 of the arm 4 opposed to the cylindrical portion 10 is slightly expanded rearwardly to define a small space 16 between the rear wall portion 15 and the cylindrical portion 10. A front wall portion 17 of the arm 4 is formed with two supporting walls 20 and 21 extending toward another rear wall portion 18 of the arm 4. There are defined two recesses 22 and 23 between a rear end of the supporting wall 20 and the rear wall portion 18 and between a rear end of the supporting wall 21 and the rear wall portion 18, respectively. A needle bar 30 having a needle 71 is vertically movably supported in a head 8 formed at the other end of the arm 4. A thread sweeping solenoid 9 is mounted on the outside of the head 8.

A main shaft 12 rotatably supported by the supporting wall 21 is provided between the AC servo motor 1 and the needle bar 30. The main shaft 12 and an output shaft 25 of the AC servo motor 1 are coaxially connected with each other by a coupling 29 rotatably supported by the supporting wall 20. A timing pulley 26 is fixed to an outer circumference of the coupling 29. A fan 27 for introducing cooling air into the AC servo motor is mounted on the timing pulley 26. A driving force of the AC servo motor 1 is transmitted through the main shaft !2 to a known mechanism for vertically moving the needle bar 30. As a result, the needle bar 30 is vertically moved.

A bottom shaft 31 is rotatably supported in the bed 70 of the frame 2. A timing pulley 32 is fixed on the bottom shaft 31 at an end portion thereof supported by pedestal 7. A timing belt 33 is wound around both the timing pulley 26 fixed to the coupling 2 and the timing pulley 32 fixed to the bottom shaft 31. The driving force of the AC servo motor 1 is also transmitted through the timing pulley 26, the timing belt 33 and the timing pulley 32 to the bottom shaft 31. The rotation of the bottom shaft 31 is transmitted to a feed rock shaft 35 and a loop taker shaft 36 provided in the bed 70. As a result, a feed dog 49 and a loop taker (not shown) are driven.

A mounting structure of the AC servo motor 1 will now be described in detail with reference to FIG. 3. The AC servo motor 1 is inserted into an internal accommodating space 57 of the cylindrical portion 10 from a right end thereof, cylindrical portion 10 and its internal space 57 comprising means for accommodating the motor, and is fixed to the cylindrical portion 10 by a screw 49. Accommodating space 57 is defined across an extension line D of right pedestal side wall 7*b*. The means for accommodating the motor further includes a frame E extending in a horizontal direction from a top portion of right pedestal side wall 7*b*, frame E supporting the motor. The output shaft 25 of the AC servo motor projects in opposite directions from the right and left ends of the cylindrical portion 10. The coupling 29 is a cylindrical member composed of a thick-walled portion 29*a* and a thin-walled portion 29*b*. The thick-walled portion 29*a* is formed with two tapped holes 40 and 41. The main shaft 12 and the output shaft 25 both inserted into the coupling 29 are coaxially connected and fixed together by two screws 42 and 43 threadedly engaged with the tapped holes 40 and 41, respectively. The thin-walled portion 29*b* is rotatably supported through a bearing 45 to the supporting wall 20, and extends rightwardly through the supporting wall 20 between the outer circumferential surface of the output shaft 25 and the inner circumferential surface of the timing pulley 26. The timing pulley 26 is composed of a body portion around which the timing belt 33 is wound and a fixing portion extending from the body portion toward the supporting wall 20. The fixing portion is provided with a tapped hole 46. The timing pulley 26 is fixedly connected to the coupling 29 by a screw 47 threadedly engaged with the tapped hole 46. That is, although the timing pulley 26 is fixed to the coupling 29, the former is not directly connected to the output shaft 25.

Figure 3:
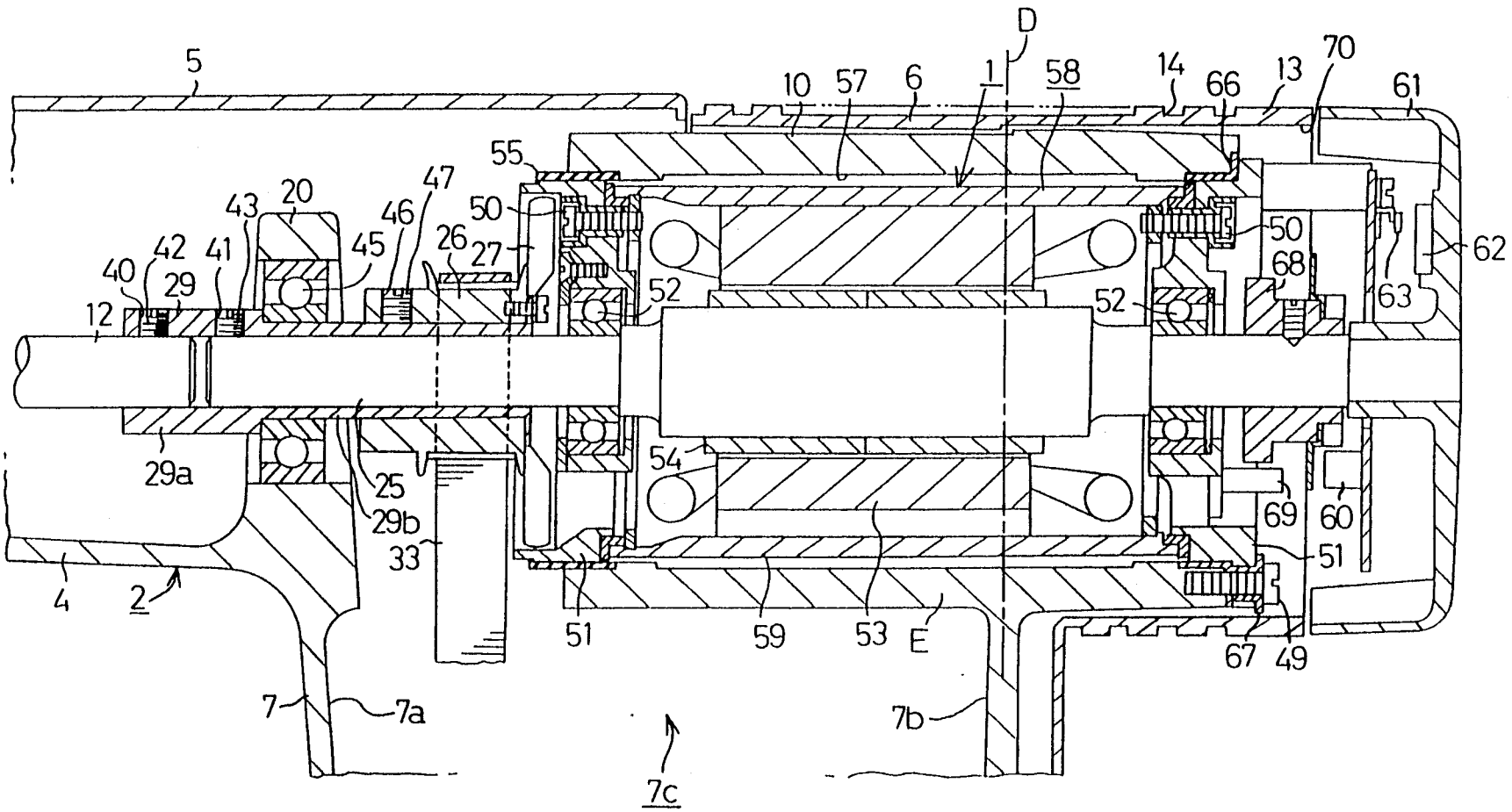
FIG. 3 is a vertical sectional view of an end portion of an arm on the side of a pedestal of the sewing machine.

In the case of removing the AC servo motor 1 from the sewing machine 3 for the purpose of maintenance or the like, the screw 43 fixing the output shaft 25 to the coupling 29 is loosened to draw the output shaft 25 rightwardly in FIG. 3. As a result, the output shaft 25 of the AC servo motor 1 is separated from the coupling 29. However, the timing pulley 26 remains fixed to the coupling 29. When mounting the AC servo motor 1 to the sewing machine 3, the same operation is carried out in the reverse order.

A housing 58 of the AC servo motor 1 is comprised of a cylindrical body 59 and a pair of right and left brackets 51 mounted on opposite ends of the cylindrical body 59 by means of screws 50. A pair of ball bearings 52 are provided in the brackets 51, respectively. The output shaft 25 is rotatably supported through the ball bearings 52 to the housing 58. A stator 53 is mounted on the inner circumferential surface of the cylindrical body 59, and a rotor 54 is mounted on the output shaft 25 at a portion thereof opposed to the stator 53.

Two elastic members 55 and 66 having a large-diameter cylindrical shape are interposed between the brackets 51 of the housing 58 and the cylindrical portion 10 of the frame 2. Another elastic member 67 having a small-diameter cylindrical shape is interposed between the right bracket 51 of the housing 58 and a screw 49 threadedly engaged with the cylindrical portion 10 through the right bracket 51. An assembly error between the main shaft 12 and the output shaft 25 in connecting the main shaft 12 through the coupling 29 to the output shaft 25 is absorbed by the operation of the elastic members 55, 66 and 67. Accordingly, the concentricity and the straightness between the main shaft 12 and the output shaft 25 are ensured.

A magnetic drum 68 is fixedly engaged with the right end of the output shaft 25 of the AC servo motor 1. A rotation sensor 69 and a pole sensor 60 are provided on an outer surface of the right bracket 51 of the AC servo motor 1 at a portion thereof opposed to the magnetic drum 68. A rotating member 61 is further mounted on the right end of the output shaft 25. A permanent magnet 62 is mounted on an inner surface of the rotating member 61. A needle position sensor 63 is provided on the right bracket 51 so as to be opposed to the permanent magnet 62.

In the sewing machine 3 having the above construction according to the preferred embodiment, when the AC servo motor 1 is energized, the output shaft 25 is rotated. As the output shaft 25 and the main shaft 12 are fixedly connected together by the coupling 29, and the timing pulley 26 is fixedly connected to the coupling 29, all of the main shaft 12, the coupling 29 and the timing pulley 26 are integrally rotated with the output shaft 25. Accordingly, a driving force of the AC servo motor 1 is transmitted to the main shaft 12, and is also transmitted through the timing belt 33 to the bottom shaft 31.

The sewing machine 3 of the preferred embodiment has the following advantages.

As the AC servo motor 1 is located in the end portion of the arm 4 which is supported by the pedestal 7, the upper structure of the sewing machine 3 is well balanced to thereby suppress the generation of vibration in the sewing operation.

As the AC servo motor 1 is located not in the central portion of the arm 4 distant from the pedestal 7 but in the end portion of the arm 4 supported by the pedestal 7, it is unnecessary to excessively increase a strength of the arm 4 and the pedestal 7. Thus, the weight of the arm 4 and the pedestal 7 can be reduced.

As the output shaft 25 of the AC servo motor 1 is coaxially connected to the main shaft 12 by the coupling 29, a loss of transmission of the driving force of the AC servo motor 1 can be reduced.

If the AC servo motor 1 is located in the central portion of the arm 4, the outer wall of the arm 4 becomes hot as a result of heat generation from the AC servo motor 1, thus causing a burn on an operator. In contrast, according to the preferred embodiment, as the AC servo motor 1 is located at a position distant from a sewing position of the operator, there is no possibility of such a burn.

As the AC servo motor 1 is located not in the central portion of the ar 4 but in the end portion of the arm 4, the operation of assembly and disassembly can be easily carried out to thereby make the maintenance speedy.

The timing pulley 26 is not directly connected to the output shaft 25 of the AC servo motor 1, but is fixed to the coupling 29. Accordingly, when separating the output shaft 25 of the AC servo motor 1 from the coupling 29 for the purpose of maintenance or the like, it is unnecessary to remove the timing pulley 26 and the timing belt 33. Accordingly, in mounting the AC servo motor 1 into the sewing machine 3, readjustment of the timing between the main shaft 12 and the bottom shaft 31 is not necessary. That is, readjustment of the operation timing between the needle bar 30 and the feed dog 49 is not necessary, thereby greatly improving an operation efficiency of assembly and disassembly.

As the assembly error between the main shaft 12 and the output shaft 25 is absorbed by the operation of the elastic members 55, 66 and 67, the concentricity and the straightness between the main shaft 12 and the output shaft 25 can be easily ensured without the necessity of advanced manufacturing techniques. Accordingly, it is possible to prevent the generation of stress, seizure, vibration and abnormal load during the operation of the sewing machine 3.

Although the main shaft 12 and the bottom shaft 31 are connected to one another by the timing belt 33 in the above preferred embodiment, a vertical shaft or the like may be used for the connection. Further, although the fan 27 is employed for cooling the AC servo motor 1 in the above preferred embodiment, a lubricating oil may be used for cooling the AC servo motor 1. Further, the AC servo motor 1 for driving the sewing machine 3 may be replaced by any other different type motor such as a DC servo motor.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A sewing machine comprising:

a bed;

a pedestal supported by said bed with a left side wall and a right side wall and having an internal hollow between said left and right side walls;

an arm having one end supported by said pedestal and having an opposite end extending in a horizontal direction;

a motor for driving said sewing machine;

a bottom shaft rotatably provided in said bed;

transmitting means provided near to said left side wall in said internal hollow for transmitting the driving force of said motor to said bottom shaft; and an accommodating means provided in said one end of said arm for accommodating said motor on the right side of said transmitting means, said accommodating means defining an accommodating space across an extension line of said right wall, said motor being mounted detachably from the accommodating space in said horizontal direction.

2. The sewing machine according to claim 1, wherein said bed and said arm extend substantially parallel to one another.

3. The sewing machine according to claim 1, wherein said motor includes an output shaft having a longitudinal axis extending in the horizontal direction toward said opposite arm end.

4. The sewing machine according to claim 3, wherein said arm has a main shaft located therein, said main shaft having longitudinal axis extending in the horizontal direction.

5. The sewing machine according to claim 4, further comprising a coupling which coaxially to couples an end of said output shaft and an end of said main shaft.

6. The sewing machine according to claim 5, wherein a timing pulley is mounted on an outer circumference of said coupling, said timing pulley having a timing belt attached thereto.

7. The sewing machine according to claim 6, wherein a bottom shaft is rotatably provided in said bed and another timing pulley is mounted to said bottom shaft.

8. The sewing machine according to claim 7, wherein said timing belt is wound around both said timing pulleys, said motor being detachable from said sewing machine without requiring removal of said timing belt and said timing pulleys.

9. The sewing machine according to claim 5, wherein said motor has a housing and said arm has an inner surface, said sewing machine further comprising at least one elastic member located between said inner surface of said arm and an outer surface of said housing of said motor.

10. The sewing machine as claimed in claim 1, wherein said accommodating means includes a frame which extends in the horizontal direction from a top portion of said right wall and supports said motor.

11. A sewing machine comprising:

a bed;

a bottom shaft rotatably provided in said bed;

a first timing pulley mounted on said bottom shaft;

a pedestal supported by said bed;

an arm having an inner surface, one end of said arm being supported by said pedestal and an opposite end of said arm extending in a horizontal direction;

a main shaft rotatably provided in said arm;

a motor for driving said sewing machine, said motor being mounted in said one end portion of said arm, said motor having a housing and an output shaft;

a coupling for coaxially connecting said main shaft with said output shaft of said motor;

a second timing pulley mounted on an outer circumference of said coupling; and a timing belt wound around said first timing pulley and said second timing pulley, whereby said motor is detachable from said sewing machine without requiring removal of said second timing pulley.

12. The sewing machine according to claim 11, further comprising:

at least one elastic member provided between said inner surface of said arm and an outer surface of said housing of said motor.

13. A sewing machine comprising:

a bed;

a pedestal supported by said bed;

an arm having an inner surface, one end of said arm being supported by said pedestal and an opposite end of said arm extending in a horizontal direction;

a motor for driving said sewing machine, said motor being mounted in said one end portion of said arm, said motor having a motor housing and a motor output shaft;

at least one elastic member provided between said inner surface of said arm and an outer surface of said motor housing;

a main shaft rotatably provided in said arm;

a bottom shaft rotatably provided in said bed;

first transmitting means for transmitting a driving force of said motor to said main shaft, wherein said first transmitting means includes a coupling for coaxially connecting said main shaft with said motor output shaft;

second transmitting means for transmitting the driving force of said motor to said bottom shaft, wherein said second transmitting means includes a first timing pulley mounted on said bottom shaft;

a second timing pulley mounted on an outer circumference of said coupling; and a timing belt would around said first timing pulley and second timing pulley, said motor being detachable from said sewing machine without requiring removal of either of said timing pulleys.

* * * * *